US006171057B1

(12) United States Patent
Chen

(10) Patent No.: US 6,171,057 B1
(45) Date of Patent: Jan. 9, 2001

(54) TABLE ELECTRIC FAN

(76) Inventor: Yen-Ching Chen, No. 13, Alley 63, Lane 37, Sec. 3, Tung Men Road, Tainan (TW)

( * ) Notice: Under 35 U.S.C. 154(b), the term of this patent shall be extended for 0 days.

(21) Appl. No.: 09/361,164

(22) Filed: Jul. 27, 1999

(51) Int. Cl.[7] ..... F01D 7/00
(52) U.S. Cl. ..... 416/100; 416/110; 416/170 R; 415/125
(58) Field of Search ..... 415/121.2, 125; 416/100, 110, 170 R, 247 R

(56) References Cited

U.S. PATENT DOCUMENTS 2,050,764 * 8/1936 Rogers ..... 416/100
2,964,583 * 12/1960 Braskamp ..... 416/100
4,486,144 * 12/1984 Hung ..... 415/121

FOREIGN PATENT DOCUMENTS 57-74609 * 5/1948 (JP) ..... 416/247 R
602284 * 5/1948 (GB) ..... 416/100

* cited by examiner

*Primary Examiner*—Edward K. Look
*Assistant Examiner*—James M. McAleenan
(74) *Attorney, Agent, or Firm*—Rosenberg, Klein & Lee

(57) ABSTRACT

A table electric fan comprising a stand, a protective net, a blade set fixed on a spindle of a motor, a speed reducer connected to the motor, a plate pivotally connected to the shaft of the speed reducer and further pivotally connected to a bottom base of a position frame having two pairs of vertical posts standing on the bottom base. The upper ends of all the posts are fixed with the protective net. A ring is pivotally connected with one pair of the vertical opposite posts and further pivotally connected with the motor at two opposite points. Then the blade set may sway for 360° within the protective net by means of pivotal connection of the motor with the ring and pivotal connection of the position frame with the ring.

1 Claim, 8 Drawing Sheets

TABLE ELECTRIC FAN

BACKGROUND OF THE INVENTION

This invention relates to a table electric fan, particularly to one having a blade set able to sway for 360° within a protective net.

A known conventional table electric fan shown in FIGS. 7 and 8, includes a bottom base 10, a motor housing 20 on the bottom base 10, a motor contained in the housing 20, a swaying device 40, a blade set 50 and a protective net 60 as main components. The swaying device 40 is connected to the spindle of the motor 30, and the blade set 50 is fixed with a front end of the spindle. Then the motor 30 with the housing 20 can be swayed to the right and the left to blow air in a room to ventilate well.

However, this conventional table electric fan only sways to the right and the left, impossible to send wind to every corner of a room, limited in ventilating effect. In addition, the swaying movement requires a proper space not to collide with things put on a table around the fan.

SUMMARY

The object of the invention is to offer a table electric fan having a blade set to sway for 360° within a limited space, without any fear to collide with other things put on a table when the blade set is swaying.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
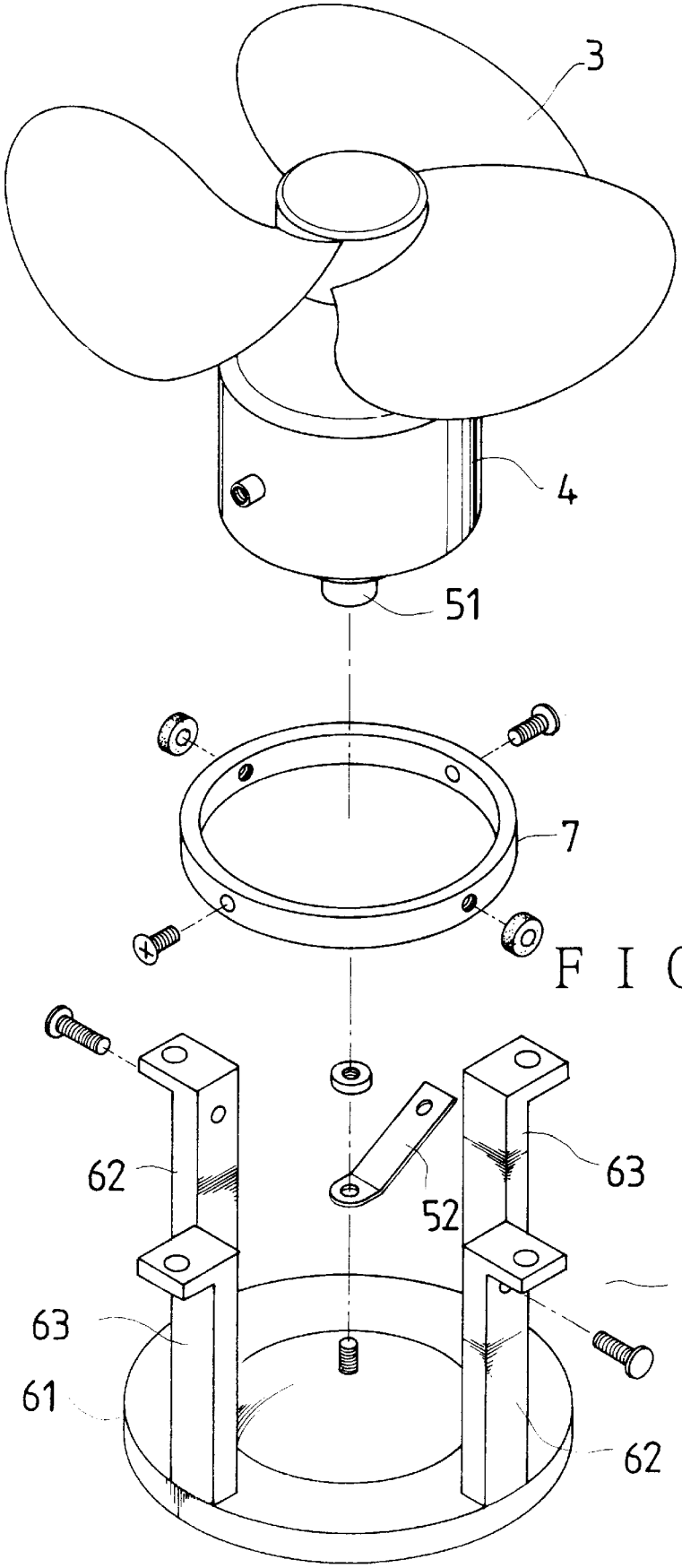
FIG. 1 is a partial exploded perspective view of a table electric fan of the present invention.
Figure 2:
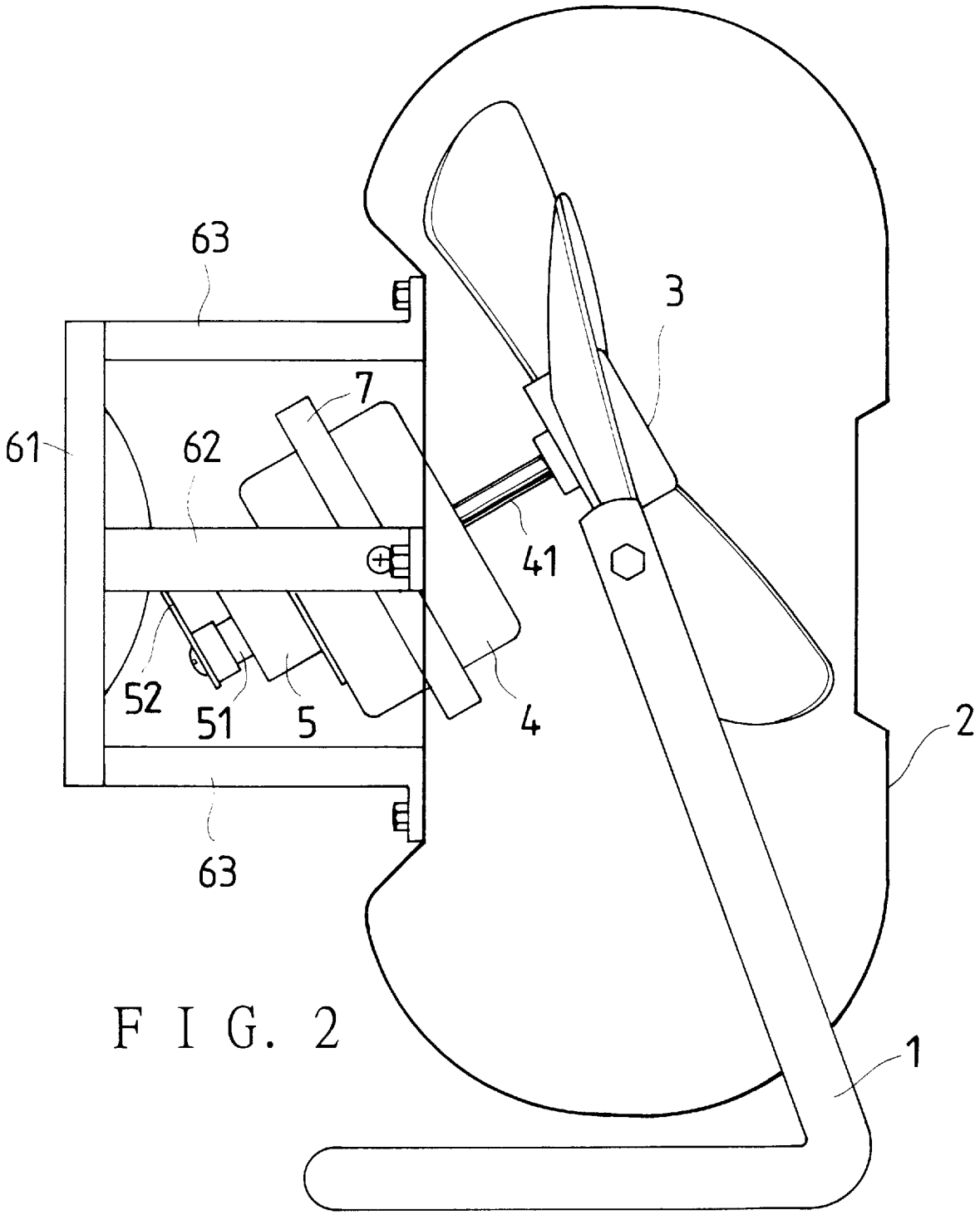
FIG. 2 is a side view of the table electric fan of the present invention.
Figure 3:
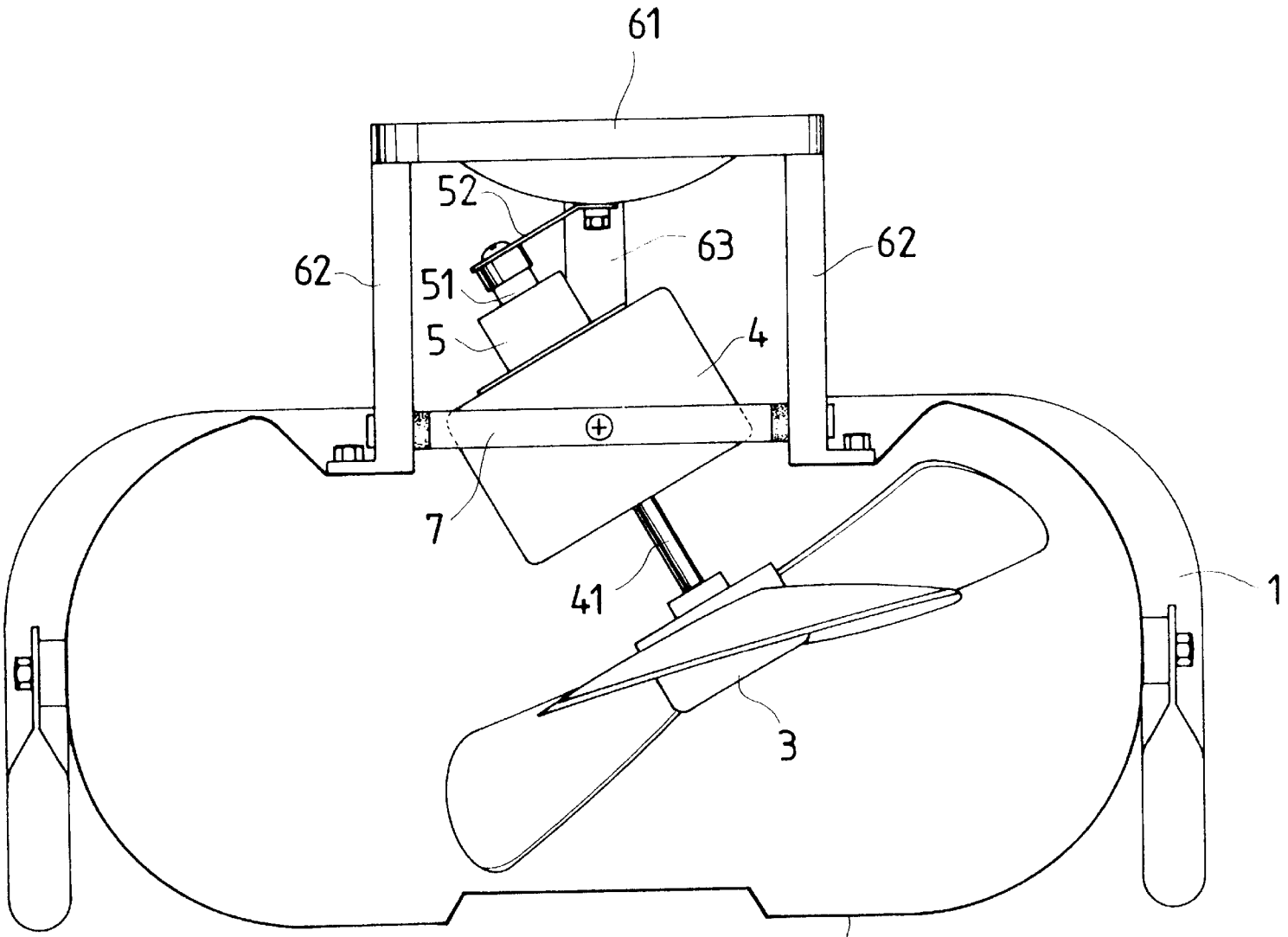
FIG. 3 is an upper view of the table electric fan of the present invention.

A preferred embodiment of a table electric fan of the present invention, as shown in FIGS. 1, 2 and 3, includes a stand 1, a protective net 2, a blade set 3, a motor 4, a speed reducer 5, a position frame 6, a ring 7 as main components.

The stand 1 has a shape to support the protective net 2 together with the motor 4 to stand on a table.

The protective net 2 has a circular shape fixed on the stand 1 and the position frame 6, having a sufficient shape to surround the blade set 3 and for the blade set to sway for 360° therein.

The motor 4 has a spindle 41 to rotate the blade set 3. A speed reducer 5 connects to the rear end of the spindle 41 and has a shaft 51 connected pivotally to a plate 52 which has the other end pivotally connected to a bottom base 61 of a position frame 6.

The position frame 6 has the bottom base 61, and two pairs of vertical opposite posts 62, 63 standing on the bottom base 61. The upper ends of all the posts 62, 63 are fixed with the protective net 2.

Figure 4:
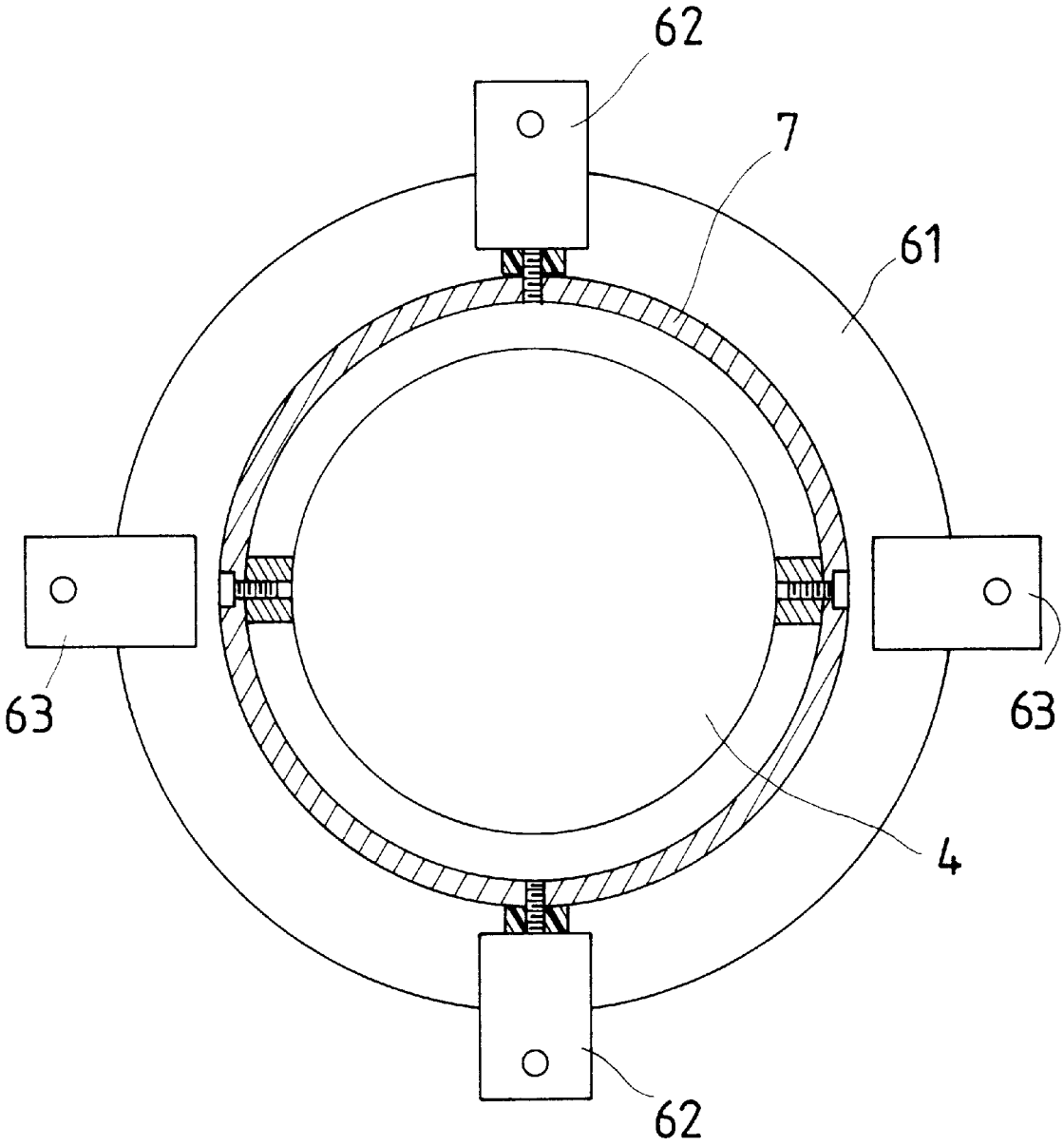
FIG. 4 is a relative view of a position frame, a motor and a ring of the present invention.

The ring 7 is pivotally connected between one pair of the posts 62 and also pivotally connected to the motor 4 at two opposite points of the outer side of the ring 7, as shown in FIG. 4.

Figure 5:
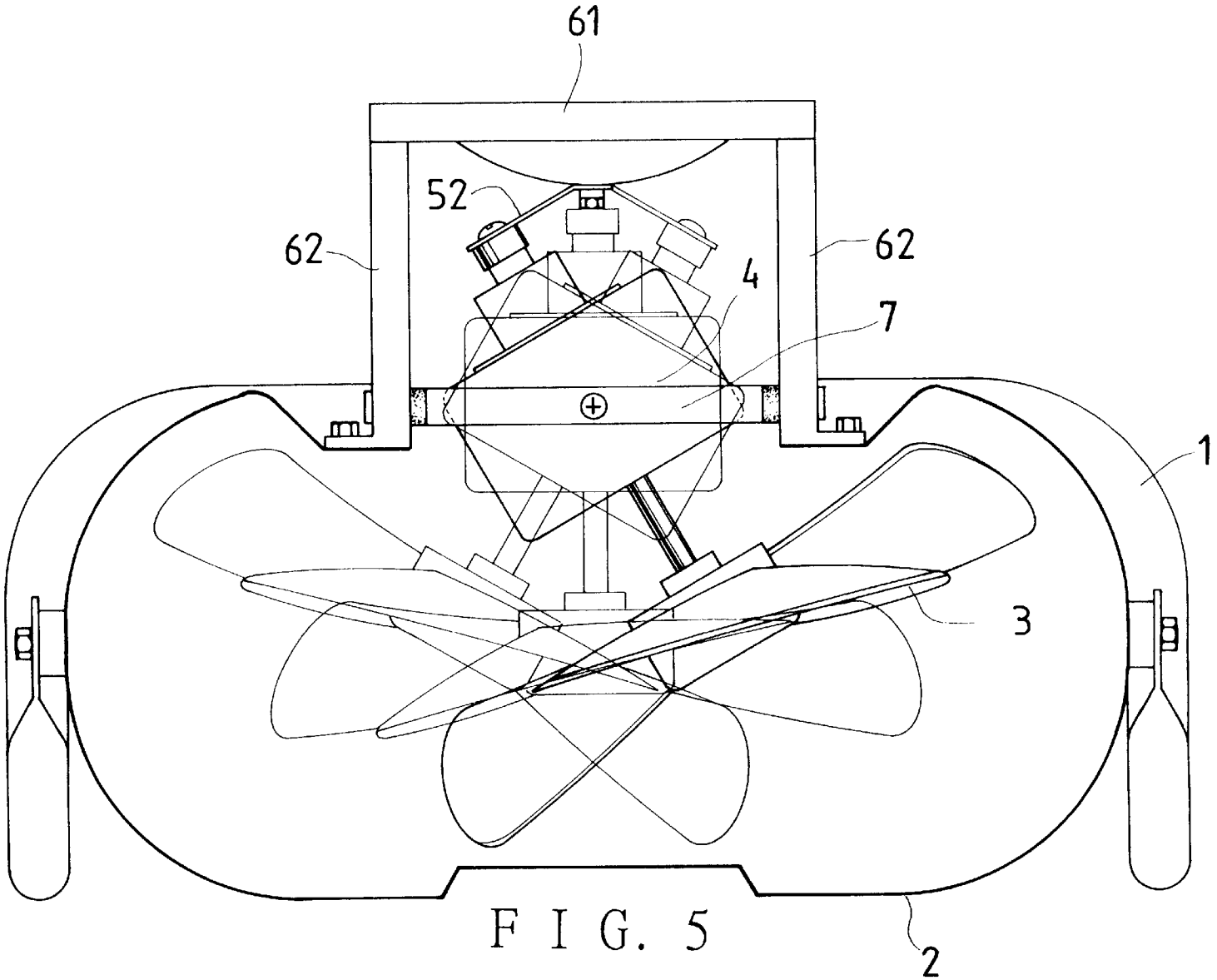
FIG. 5 is an upper view of the table electric fan with the blade set being swayed of the present invention.
Figure 6:
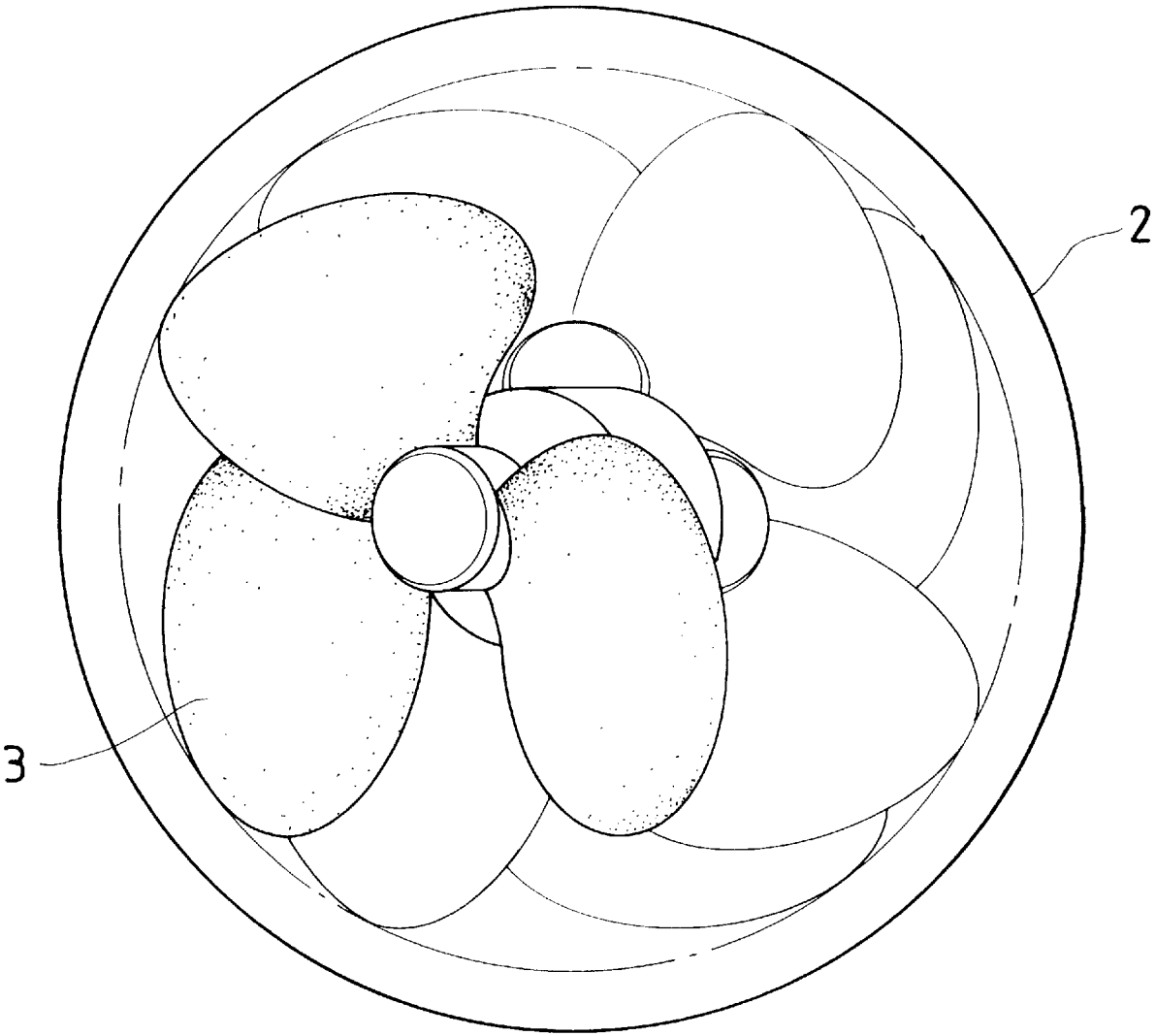
FIG. 6 is a front view of the table electric fan being swayed of the present invention.
Figure 7:
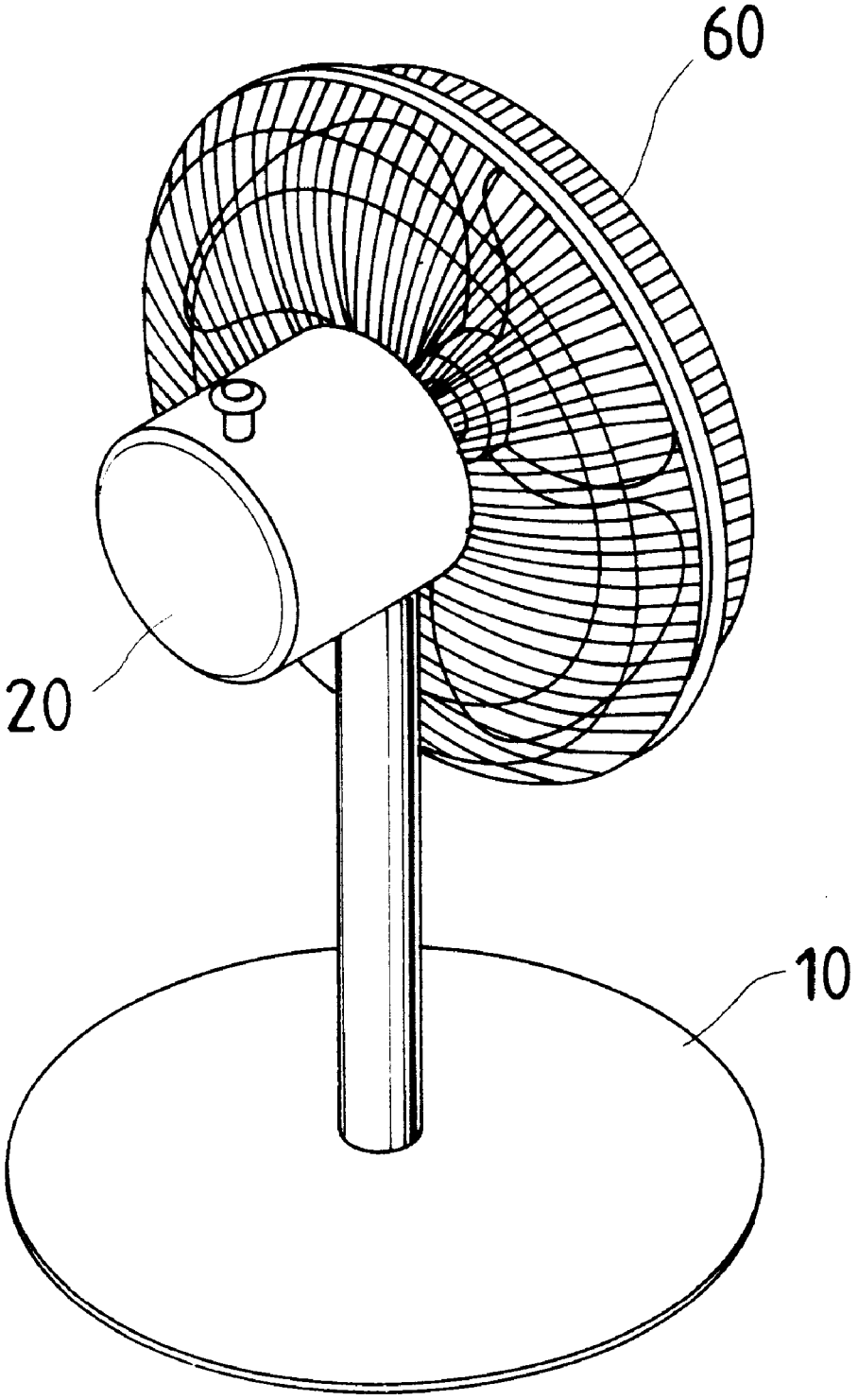
FIG. 7 (PRIOR ART)
FIG. 7 is a perspective view of a known conventional table electric fan.
Figure 8:
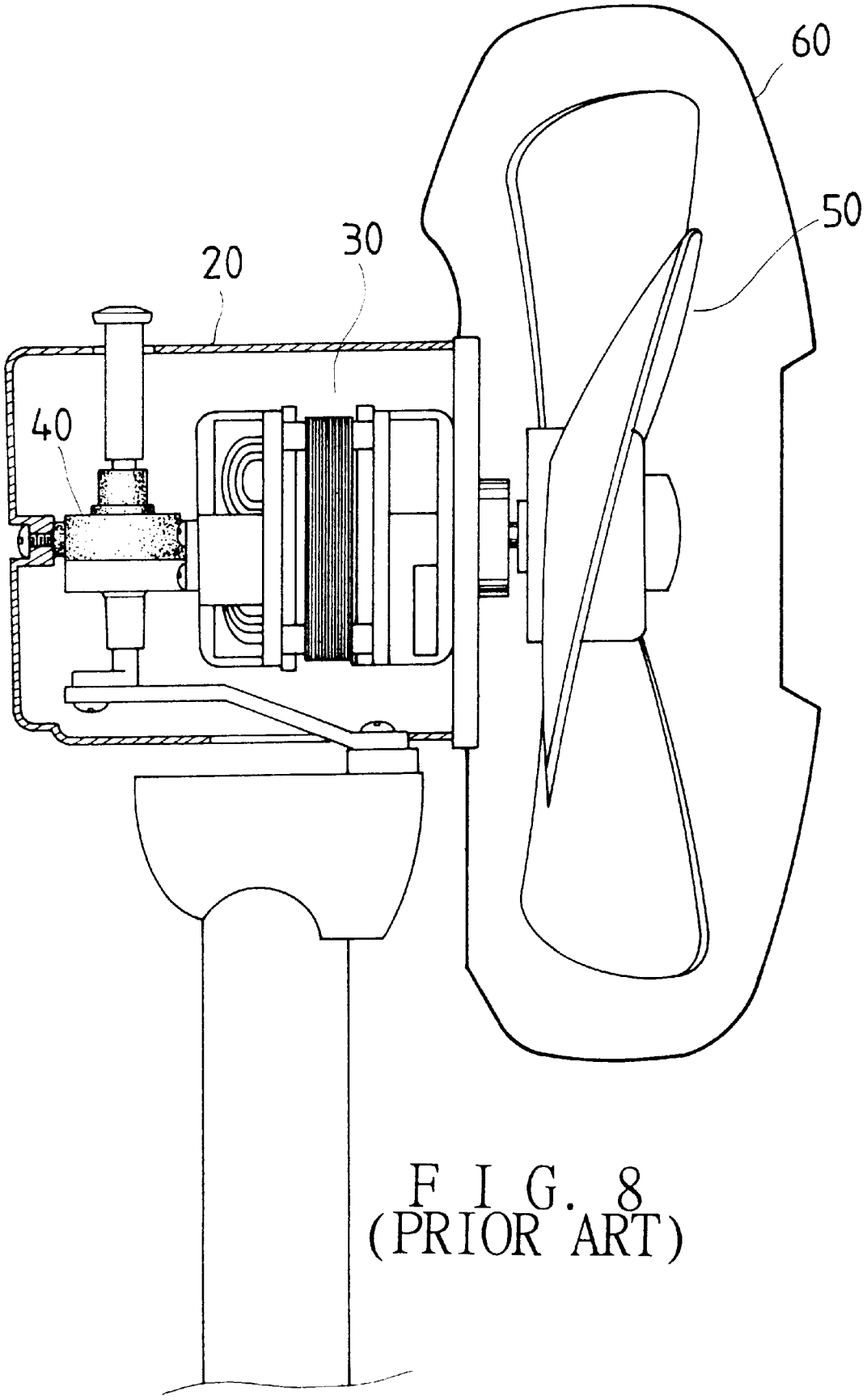
FIG. 8 (PRIOR ART)
FIG. 8 is a side cross-sectional view of the known conventional table electric fan.

When the motor 4 in the table electric fan works, the blade set 3 is rotated, with the plate 52 swaying by the speed reducer 5 connected with the motor 4 and with the connecting point with the bottom base 61 functioning as a pivot. Further at the same time, the blade set 3 may be swayed for 360° by means of the pivotal connection of the motor 4 with the ring 7 and pivotal connection of the two posts 62 with ring 7, as shown in FIGS. 5 and 6.

As can be understood from the aforesaid description, the table electric fan of the invention has the following advantages.

1. As the blade set with the motor can be swayed for 360°, the wind produced by the blade set can reach very widely to every corner of a room, increasing ventilation in the room.
2. It does not occupy large space as well as not collide with any things on a table as the blade set sways within the protective net.

What is claimed is:

1. An automatic fan comprising:

(a) a stand for providing free standing support upon a surface;

(b) a protective net coupled to said stand, said protective net defining a protected compartment;

(c) a position frame fixedly coupled to said protective net, said position frame having a base and a plurality of posts extending transversely therefrom, at least a pair of said posts being spaced one from the other in opposed manner;

(d) a ring pivotally coupled to said pair of posts about a first pivot axis; and, (e) a blade assembly coupled to said ring and said position frame, said blade assembly including:

(1) a motor pivotally coupled to said ring about a second pivot axis, said motor having a spindle extending rotatably therefrom;

(2) a speed reducer coupled to said spindle;

(3) a plate extending radially from said speed reducer, said plate being pivotally coupled to said base of said position frame; and, (4) a blade set coupled to said spindle for axial rotation therewith responsive to actuation of said motor, said blade set being automatically displaceable in axial orientation within said protected compartment about both said first and second pivot axes responsive to said motor actuation.

* * * * *